United States Patent [19]

Windley

[11] Patent Number: 4,752,514

[45] Date of Patent: Jun. 21, 1988

[54] CELLULAR FIBER WITH COLLAPSED CELLS AT BENDS

[75] Inventor: William T. Windley, Seaford, Del.

[73] Assignee: E. I. Du Pont de Nemours and Company, Wilmington, Del.

[21] Appl. No.: 860,252

[22] Filed: May 6, 1986

[51] Int. Cl.[4] ..... B32B 3/02; D02G 3/00

[52] U.S. Cl. ..... 428/97; 428/359; 428/362; 428/369; 428/398; 19/66.1; 264/168

[58] Field of Search ..... 428/359, 362, 398, 97; 19/66.1; 264/168

[56] References Cited

U.S. PATENT DOCUMENTS

| | | | |
|---|---|---|---|
| 3,322,611 | 5/1967 | Stevenson | 428/398 |
| 3,582,418 | 6/1971 | Schuur | 428/373 |
| 3,745,061 | 7/1973 | Champaneria et al. | 428/392 |
| 4,001,367 | 1/1977 | Guthrie et al. | 524/117 X |
| 4,380,594 | 4/1983 | Siggel et al. | 521/189 |
| 4,485,141 | 11/1984 | Fujimura et al. | 428/362 |
| 4,511,623 | 4/1985 | Yoon et al. | 428/359 |
| 4,544,594 | 10/1985 | Li et al. | 428/92 |

*Primary Examiner*—Sharon A. Gibson

[57] ABSTRACT

A crimped fiber having a plurality of cells and bends characterized by the total area occupied by the cells within a cross-section of the fiber at the bends being less than 50% of the area occupied by the cells within a cross-section of the fiber at other than the bends.

12 Claims, 4 Drawing Sheets

10 μ

10 μ

10 μ

CELLULAR FIBER WITH COLLAPSED CELLS AT BENDS

TECHNICAL FIELD

This invention relates to fiber containing cells which when subjected to a stuffer box crimper has cells within the fiber which occupy less than 50% of the area occupied by the cells within the fiber at other than the bends.

BACKGROUND

Synthetic polymeric filaments which are to be cut into staple then twisted into staple yarn usually must be crimped before cutting so that the staple will behave properly in the drafting and twisting operations. Crimp is also needed to contribute bulk, softness and insulating ability to yarns, either staple or continuous filament, which are to be used for garments, upholstery or carpets. The twisting operation tends to compact the filaments and straighten the crimp. It is desirable that filaments have crimp which resists such compacting and straightening. Such filaments are usually crimped by a mechanical stuffer box, in which nip rollers force the filaments into a chamber having a means to impede their exit so that the filaments are forced to bend in a zig-zag manner as they encounter a mass of previously crimped material. The filaments are heated by various means as they are crimped, then and as they cool when leaving the stuffer box a considerable portion of the crimp which they receive is retained.

Most useful polymeric filaments resist permanent deformation during crimping and tend to spring back toward their original straight condition, thus minimizing the sharpness of the bends and the resultant degree of bulk exhibited by the final yarns. When the bending modulus of filaments is lowered in an attempt to obtain sharper bends, such as by orienting the filaments less or by copolymerizing, it is usually found that such filaments also tend to lose their crimp more readily when they are tensioned in handling after crimping or when they are drafted, twisted and subjected to normal tension of use in fabric form.

SUMMARY OF THE INVENTION

A crimped fiber having a plurality of cells and bends characterized by the total area occupied by the cells within a cross-section of the fiber at the bends of less than 50% of the area occupied by the cells within a cross-section of the fiber at other than the bends has now been discovered. The fiber is further characterized by the minimum radius of a bend being less than the diameter of the fiber a Filament Crimp Index of greater than 23, and the angle of the bend being less than 120 degrees, preferably about 90 degrees. The fiber is preferably a polypropylene polyester or polyamide fiber and is especially useful for making carpet.

The fiber of the present invention is further characterized by substantially gas-filled cell content of ½–50% by volume, essentially all of the cells being closed, being of 0.2–25 microns in diameter and having a length to diameter ratio of greater than 500, preferably greater than 2000. The fiber is further characterized by a plurality of the cells having a diameter of greater than one-twentieth the effective diameter of the fiber, a detectable level of fluorocarbon in the fiber and greater than 3 cells per fiber. For polyamides the fluorocarbon is from the group comprising dichlorotetrafluoroethane (FC-114), monochloropentafluoroethane (FC-115) and dichlorodifluoromethane (FC-12).

DETAILED DESCRIPTION OF THE DRAWINGS

Figure 1:
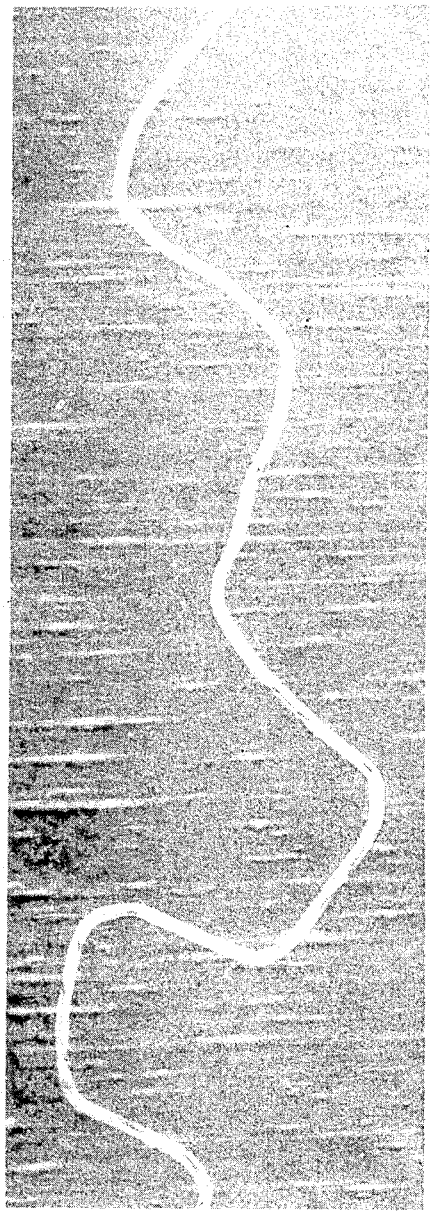
FIG. 1 is a photograph of the staple fiber of Control A taken at a magnification of 50.
Figure 2:
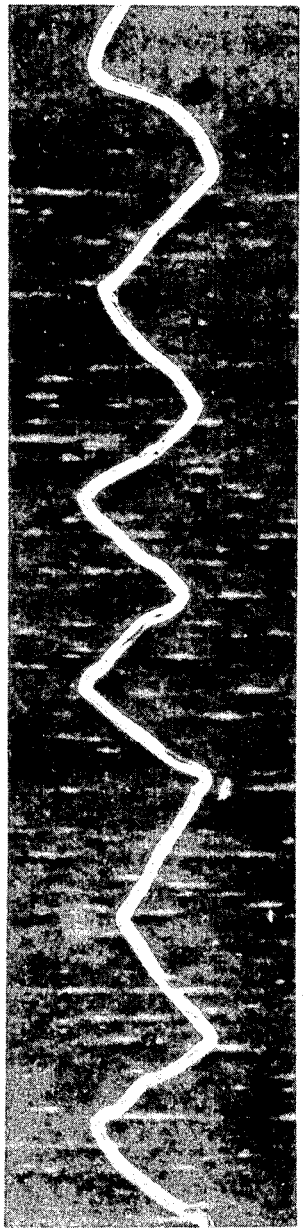
FIG. 2 is a photograph of the staple fiber of Example 1 taken at a magnification of 50.

Filaments of the invention, having cells display an unexpected behavior when crimped in a mechanical stuffer box. Referring to FIG. 1, a relaxed filament of Control A without cells which has been crimped in a mechanical stuffer box typically has crimps of a minimum radius at the inside of a bend equal to or greater than the diameter of the filament. Under the particular crimping conditions employed, 6 bends are visible and each forms an obtuse angle. FIG. 2 shows a relaxed filament of Example 1 with cells which has been crimped under the same conditions. The minimum radius at the inside of a bend is characteristically less than the filament diameter, 11 bends are visible and each forms an angle averaging about 90° and all angles at the bends are less than 120° C. Yarn products made from such filaments have about 25% greater bulk than yarn products made from the filament shown in FIG. 1.

Figure 3:
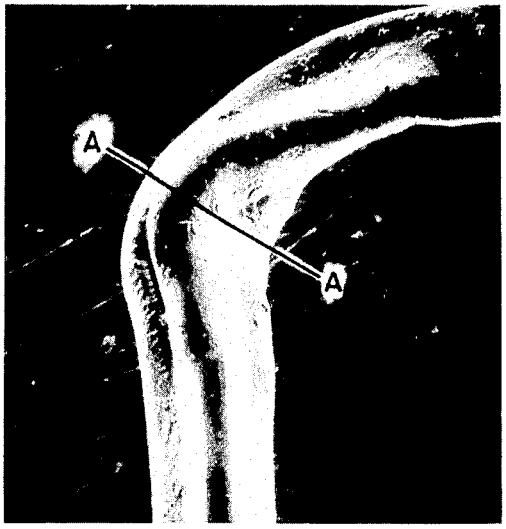
FIG. 3 is a photograph of a single crimp from a fiber of Example 1 shown at a magnification of 500.
Figure 4:
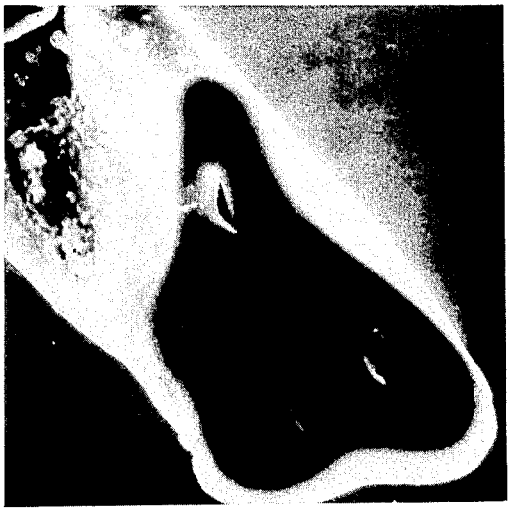
FIG. 4 is a cross-section of a fiber of Example 1 made at a region of least bend radius and shown at a magnification of 900.

FIG. 3 is an enlarged view of a single bend from the trilobal product of FIG. 2 showing compression buckling at the inside of the bend. FIG. 4 shows a cross-section of another bend from the same product made at the point of least bend radius such as line A—A of FIG. 3. Some cells in the polymer have been greatly reduced in size by the buckling of the polymer and others have been closed. The total area of cells at a bend is found to be less than 50% of the area of cells measured at an unbuckled location between bends.

Figure 5:
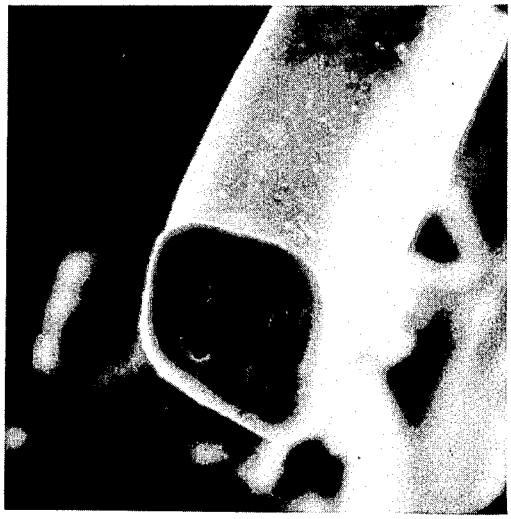
FIG. 5 is a photograph of a cross-section of a fiber spun in accordance with U.S. Pat. No. 3,745,061 without the cells of the present invention, the cut being made at a region of least bend radius and shown at a magnification of 900.

FIG. 5 shows a cross-section taken at a bend of a nylon filament having four non-round cells of substantially constant size and location continuously along the length of the filament, formed in accordance with Champaneria et al U.S. Pat. No. 3,745,061 which has been crimped in a mechanical stuffer box. There is no substantial compression buckling at the bend and the total area of cells at the bend is >50% of the area of cells measured at a location between bends.

Figure 6:
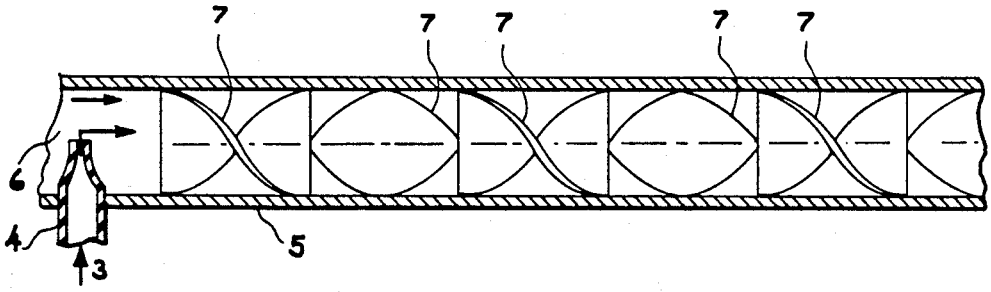
FIG. 6 is a schematic drawing of one method of injecting blowing agent into a molten polymer pipeline and mixing it into the polymer.

Referring to FIG. 6, blowing agent 3 is delivered from a pump (not shown) capable of very accurate metering of very small flow rates at pressures higher than that of the polymer and is injected through nozzle 4 into the center of pipe 5 carrying molten polymer 6. The polymer and blowing agent enter one or more mixers 7 which may either be of the static type such as are made by Kenics, shown here, or powered mixers.

Figure 8:
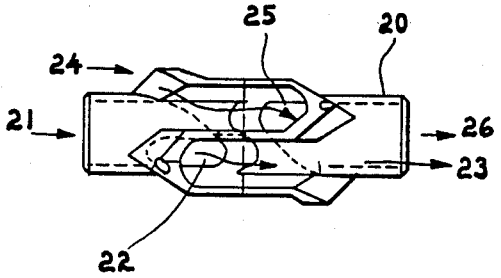
FIG. 8 is one type of flow inverter which may be used in a polymer pipeline.

Referring to FIG. 8, a flow inverter 20 may be inserted into the polymer transfer line and may be beneficial for increasing the thoroughness of mixing of blowing agent into polymer. In the inverter shown, polymer 21 flowing near the axis of the line emerges outwardly from three holes 22 equally spaced about the device and flows along the periphery 23 of the line while polymer approaching flow inverter 20 near the periphery flows inwardly through holes 25 and emerges near the axis 26. This device may be placed after a series of mixers 7 of FIG. 6 and may be followed by other mixers 7. The mixture of polymer and blowing agent then passes through a meter pump, filter medium, distributor plate and spinneret designed to promote outgassing and bubble formation.

Figure 7:
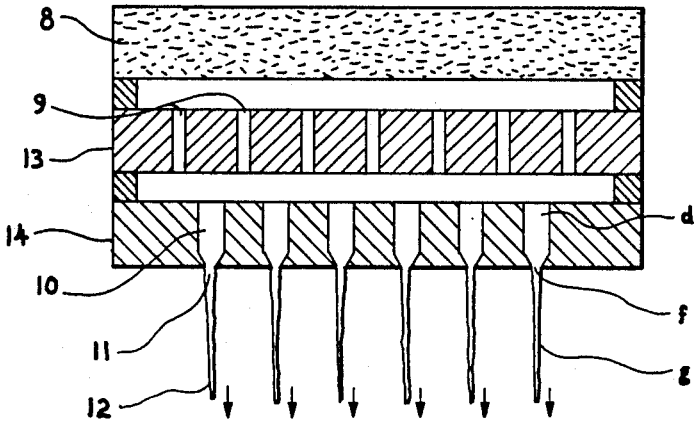
FIG. 7 is a schematic diagram of one type of spinning pack.

One means of providing such conditions is shown in FIG. 7, wherein the polymer undergoes shear in filter medium 8 which helps to distribute the blowing agent uniformly throughout the polymer and aids bubble nucleation. Mixing and shear nucleation are also aided by the action of polymer meter pumps which are usually of the gear type. Higher pump speeds give greater shearing and mixing action. Such shear also gives decreased melt viscosity of the polymer which aid outgassing.

The shear also raises the temperature of the polymer and reduces its viscosity, which facilitates bubble growth. The polymer then passes through a small-diameter orifice 9 in plate 13 sized to provide a large pressure drop at the desired polymer throughput into chamber 10 of spinneret 14 having a larger diameter outlet 11.

The volume of chamber 10 may be sized to provide a much greater then usual hold-up time and pressure drop for bubble growth, and the diameter and length at outlet 11 may be sized to provide a desired hold-up time and pressure; larger diameters and shorter lengths giving lower pressure, and longer lengths of low-pressure ducts giving more growth.

Polymer containing bubbles then emerges from outlet 11 at low velocity and is drawn away to form filaments 12, the bubble cells becoming highly elongated and reduced in diameter.

Another means of providing a desired hold-up time at low pressure is to use larger distribution (meter) plate capillaries above the spinneret. Also thicker spinnerets with longer counterbores and capillaries will increase hold-up time at low pressure. The need for hold-up time at low pressure must be balanced with the need for pre-shear above the capillary for bubble nucleation.

Products of the invention may be made from polyethylene terephthalate, polypropylene, nylon 66 and nylon 6. Copolymers of nylon 66 and 6 are particularly suitable because of the greater solubility of the preferred fluorocarbons in such copolymers. A copolymer containing about 4% nylon 6 is particularly useful, having a lower melting point, less degradation, less gel propensity and a higher dye rate than nylon 66.

Preferred blowing agents for use in polyester and nylon 66 are dichlorotetrafluoroethane (FC-114), boiling point 3.8° C. at atmospheric pressure, and monochloropentafluoroethane (FC-115), boiling point −38.7° C. or dichlorodifluoromethane (FC-12), boiling point −29.8° C. with stabilizer because they do not decompose at the temperatures and times needed for adequate mixing of the blowing agent and spinning of the polymer.

Fluorocarbons which decompose, can discolor and degrade the polymer. Slight decomposition can be seen as a yellowing of the fiber while more severe decomposition can blacken it and cause deposits of degraded polymer in the spinning equipment. Also, in decomposing, the fluorocarbon releases hydrochloric acid which corrodes the equipment.

One suitable stabilizer for FC-12 is di-2-ethylhexyl phosphite, which may also be used with FC-114 under severe conditions. Nylon 6 can use FC-12 without stabilizer because of its lower melting point. Polypropylene can employ FC-22 or FC-115. However, FC-114 and FC-115 are preferred because they are satisfactory with a wide variety of polymers at any reasonable processing conditions.

TEST METHODS CRIMPS PER CENTIMETER AND FILAMENT CRIMP INDEX

Crimp frequency and filament crimp index are determined from measurements made on the same instrument, a 500-mg capacity Roller-Smith analytical balance (made by Biolar Corp. of North Grafton, Mass.). Crimp frequency is defined as the number of crimps per extended length in centimeters of a boiled-off, conditioned fiber, with the crimp being counted while the fiber is under 2 mg/den tension and the extended length being measured while the fiber is under 50 mg/den tension. A crimp is one complete crimp cycle (e.g., sine wave or helix turn) characteristic of the specimen's crimp form.

Filament crimp index is defined as the difference in length of a boiled-off, conditioned fiber, measured (a) with 2 mg/den tension versus (b) with 50 mg/den tension, and is expressed as a percent of the extended length at 50 mg/den tension. The analytical balance used for these measurements is equipped with (1) a 100 mg-clamp hanging from the balance beam and (2) a vertically movable clamp, called a "transport", that has an associated vertical transport scale, which permits measurement of the extension of the fiber to within 0.01 centimeter. Initially the transport is adjusted so that the transport clamp and the balance clamp just touch each other and while in this position the vertical transport scale is read ($R_0$). A boiled-off, conditioned fiber is then mounted in the balance clamp and transport clamp, with the clamps positioned approximately 2 cm apart. The transport clamp is then moved until the fiber is under 2 mg/den tension. With the fiber under this tension, the transport scale is read again ($R_1$) and the number of crimps (N) is counted with the aid of a 2X magnifying glass. The transport is then moved until the tension is 50 mg/den, at which point, the transport scale is read again ($R_2$) From these data, crimp frequency, in crimps per extended centimeter, is calculated as $N/(R_2-R_0)$ and filament crimp index is calculated as $100(R_2-R_1)/(R_2-R_0)$. The results as reported for the average of twenty fibers per sample.

PERCENT CELLS

Filaments to be measured for cells are embedded in thermosetting resin, and cross-section slices are cut at desired locations. The slices are mounted on microscope slides and are photographed at an appropriate magnification such as 900×. They are then placed on the stage of a digitizing planimeter (make and model) and a stylus is moved around the outline of each cell. A computer in the planimeter calculates the total area of all cells. The area of the whole filament is then traced similarly and the percent cells is calculated by dividing the total cell area by the area of the whole filament. The percent cells at a bend is divided by the percent cells between bends to calculate the degree of collapsing of cells at bends.

BEND RADIUS

Filaments to be measured are boiled at zero tension to develop maximum crimp then are dried. A section of crimped filament is placed on a microscope slide, straightened just sufficiently to remove kinks or coils, and another glass is placed on top to flatten the filament. It is photographed at a magnification which includes at least 6 bends and at the same time is large enough so that both the filament diameter and the bend radii can be measured accurately. A transparent template having holes of various sizes is placed on the photograph and the radius of each bend is determined by comparison. An average of 6 bends is calculated and this figure is divided by the diameter of the filament as measured on the photograph to determine the average bend radius in terms of filament diameters.

CELL LENGTH DIAMETER RATIO

The cell length is measured by cutting yarn filaments to a length of 1½ inches, mounting the filaments on a standard glass slide, covering the filaments on the slide with Cargill Type "A" Immersion Oil, and covering the filaments and oil with a cover-glass. The slide is then placed on a conventional optical microscope with an incandescent transmitted light illuminator and the length of the filaments recorded at a magnification of 100×. The filaments are then observed at a magnification of 293× and the cell diameter recorded. The ratio of cell length to cell diameter is then calculated and reported as cell "L/D". A micron scale within the microscope optics is used to make the measurement.

EXAMPLES

In Example 1 FC-114 is injected, as indicated in FIG. 6, by a LEWA diaphragm pump at a rate of 1.04 g/min into a pipe carrying a salt blend copolymer of 96% nylon 66 and 4% nylon 6 giving 0.19% FC-114 in the polymer. There are 14 Kenics mixers in the pipe after the injection point and a flow inverter as shown in FIG. 8 is installed after the first 7 Kenics mixers giving a well distributed mixture of polymer and FC-114. The FC-114 dissolves in a polymer at a pressure of 126.5 kg/cm$^2$ and temperature of 287° C. existing in the pipe. The polymer then passes through a two stream 4.7 cc capacity meter pump producing a shear rate of 13034 sec$^{-1}$, through a filter to remove foreign matter and gelled polymer then through a distributor plate described in Table I and into a spinneret as shown in FIG. 7, having 160 capillaries.

As shown in Table I the spinneret has a larger diameter capillary than is typical for melt spun filaments, which is followed by a significantly larger counterbore wherein the polymer resides at low pressure while the fluorocarbon comes out of solution and forms bubbles. The exit of this passage is in the form of three radial slots, giving filaments of trilobal shape. As the slowly advancing polymer emerges from the spinneret, filaments are drawn away at a drawdown ratio of 533. The filaments are solidified, cooled by crossflow quench air and are collected.

Several groups of undrawn filaments are then fed simultaneously into a draw crimp machine where they are drawn between two sets of rolls, the second set rotating at a faster rate, and enter a stuffer box crimper. The filaments are heated to some extent by the drawing operation, then nip rolls of the crimper grip the filaments and force them into a chamber having a means to impede their exit so that they are forced to bend in a zig-zag manner as they encounter a mass of previously crimped material. The work done on the filaments by the nip rolls heats them further, making them more pliable and receptive to crimping. The filaments are then cut into staple.

Control A is produced similar to Example 1 except that no fluorocarbon is added, the spinneret capillary and counterbore as indicated in Table I are smaller and more nearly conventional, and consequently the shear rate in the spinneret is higher. The jet velocity of the polymer is therefore higher and the drawdown lower, but the denier of the filaments of both Example 1 and Control A after stretching between the spinneret and the first powered roller are approximately 40.6 denier and after cold drawing are approximately 14.4 denier. Each product is crimped in the mechanical stuffer box, adjusted to give approximately equal crimp elongation under a standard load. The filaments of both Example 1 and Control A are cross-sectioned and photograph at a magnification of 900X. The filaments of Example 1 have about 15.5 cells per fiber which occupy about 8.9% of the area of the fiber cross-section between bends. At a bend shown in FIG. 4 the cells occupy only 2.3% of the area of the cross-section or approximately 25.9% of the area occupied by the cells between bends. A sample carpet made from the yarn of Example 1 when evaluated against a similar carpet from Control A by a panel of 12 people was judged to have about 25% more bulk. This is consistent with the Filament Crimp Index of Example 1 being about 34.6% higher than the Filament Crimp Index for Control A.

TABLE I

| | Example 1 | Control A |
|---|---|---|
| Polymer Type | Nylon 66/6 | Nylon 66/6 |
| Freon Type | FC-114 | None |
| Freon Rate (g/m) | 1.04 | 0 |
| Pump Shear Rate (Sec$^{-1}$) | 13034 | 13034 |
| Distributor Spec. | | |
| Capillary Dia. (cm) | 0.157 | 0.157 |
| Capillary Length. (cm) | 1.588 | 1.588 |
| Counterbore Dia. (cm) | 0.475 | 0.178 |
| Counterbore Length (cm) | 1.270 | 1.270 |
| Jet Velocity (cm/min) | 92.54 | 92.54 |
| Shear Rate (Sec$^{-1}$) | 78.33 | 78.33 |
| Spinneret Details | | |
| Capillary Diam. (cm) | 0.175 | 0.055 |
| Capillary Lgth. (cm) | 0.030 | 0.030 |
| Counterbore Diam. (cm) | 0.475 | 0.178 |
| Jet Velocity (cm/min) | 127.7 | 1292.5 |
| Shear Rate (Sec$^{-1}$) | 204.2 | 6146.9 |
| Melt Viscosity (poise) | 1000 | 360 |
| Differential Pressure kg/cm$^2$ | 0.069 | 2.557 |
| Draw-Down | 533. | 52.7 |
| Product Properties | | |
| Filament Diameter | 52μ | 52μ |
| Denier/Filament | 14.3 | 14.5 |
| Tenacity g/d | 4.18 | 4.16 |
| Elongation (%) | 56. | 73. |
| Cells/Fiber | 15.5 | 0 |
| Filament Crimp Index | 27.34 | 20.31 |
| Crimps/cm | 6.08 | 4.49 |

TABLE I-continued

| | Example 1 | Control A |
|---|---|---|
| Ave. radius of bends | 19.9μ | 119.6μ |

I claim:

1. A polyamide crimped fiber having a plurality of closed cells and bends characterized by the total area occupied by the cells within a cross-section of the fiber at the bends being less than 50% of the area occupied by the cells within a cross-section of the fiber at other than the bends and the angle of the bends being less than 120 degrees.

2. A crimped polypropylene fiber having a plurality of closed cells and bends characterized by the total area occupied by the cells within a cross-section of the fiber at the bends being less than 50% of the area occupied by the cells within a cross-section of the fiber at other than the bends and the angle of the bends being less than 120 degrees.

3. A crimped polyester fiber having a plurality of closed cells and bends characterized by the total area occupied by the cells within a cross-section of the fiber at the bends being less than 50% of the area occupied by the cells within a cross-section of the fiber at other than the bends and the angle of the bends being less than 120 degrees.

4. The fiber as in claim 1, 2 or 3 further characterized by the minimum radius of a bend of less than the diameter of the fiber.

5. The fiber of claim 4 further characterized by a Filament Crimp Index of greater than 23.

6. The fiber of claim 4 further characterized by the angle of the bend of about 90 degrees.

7. A carpet made from the fiber of claim 5.

8. A fiber of claim 4 further characterized by substantially gas-filled cell content of ½-50% by volume, The cells being 0.2–25 microns in diameter and having a length of diameter ratio of greater than 500.

9. the fiber of claim 8 wherein a plurality of the cells have a diameter of greater than one-twentieth the effective diameter of the fiber.

10. The fiber of claim 8 further characterized by at least 3 cells per fiber.

11. The fiber of claim 8 wherein the length to diameter ratio is greater than 2000.

12. A carpet made from the fiber of claim 11.

* * * * *